United States Patent [19]

Johanns et al.

[11] 4,331,904

[45] May 25, 1982

[54] COLOR TELEVISION DISPLAY TUBE

[75] Inventors: Johannes H. M. Johanns; Arnoldus H. M. van Eck, both of Eindhoven, Netherlands

[73] Assignee: U.S. Philips Corporation, New York, N.Y.

[21] Appl. No.: 113,842

[22] Filed: Jan. 21, 1980

[30] Foreign Application Priority Data

Mar. 20, 1979 [NL] Netherlands ..... 7902159

[51] Int. Cl.[3] ..... H01J 29/02; H01J 29/50

[52] U.S. Cl. ..... 313/417; 313/457

[58] Field of Search ..... 313/417, 457, 414

[56] References Cited

U.S. PATENT DOCUMENTS

| | | | |
|---|---|---|---|
| 2,825,845 | 3/1958 | Jonker et al. | 313/414 X |
| 2,825,847 | 3/1958 | De Gier | 313/414 X |
| 3,254,251 | 5/1966 | Hughes | 313/414 |
| 3,974,416 | 8/1976 | van der Goot et al. | 313/417 |
| 4,061,942 | 12/1977 | Andre | 313/457 X |

FOREIGN PATENT DOCUMENTS 2526210 12/1976 Fed. Rep. of Germany .

*Primary Examiner*—Palmer C. Demeo

*Attorney, Agent, or Firm*—Robert J. Kraus

[57] ABSTRACT

A color television display tube comprising three electron guns arranged in line and each comprising successively a triode part, a first lens electrode and a second lens electrode. The first lens electrode of each of the outermost guns is secured to insulating assembly rods by means of two suspension braces situated at an axial distance from each other in such manner that the brace situated nearer the triode part is secured to the outer surface of the first lens electrode remote from the central electron gun and the brace situated nearer the second lens electrode is secured to the outer surface of the first lens electrode facing the central electron gun. Such a construction results in a low thermal convergence drift.

1 Claim, 2 Drawing Figures

COLOR TELEVISION DISPLAY TUBE

BACKGROUND OF THE INVENTION

The invention relates to a color television display tube comprising, in an evacuated envelope, an electron gun system having three electron guns arranged in line to generate three converging electron beams. The electron guns each comprise, in the direction of propagation of the electron beams, a triode part, an elongate first lens electrode and a second lens electrode. The first lens electrodes are secured to insulating assembly rods extending substantially in the axial direction of the gun system by means of first and second axially-spaced metal suspension braces, respectively.

An electron gun system for such a color television display tube is described in German Offenlegungsschrift No. 2526210.

It has been found that in color television display tubes the convergence of the electron beams changes in the period between switching on the tube and the instant at which it reaches its operating temperature. This convergence drift is particularly a result of thermal expansion of the electrodes and the metal suspension braces connected thereto, so that a variation in the position of the electrodes of the two outermost guns with respect to that of the central gun may occur. Furthermore, in the case of a thermal expansion of a suspension brace, forces may be exerted on the assembly rods connected thereto. These forces are transferred by the assembly rods to suspension braces connected to other electrodes, so that the positions of the other electrodes vary.

U.S. Pat. No. 3,974,416 proposes to reduce the so-called thermal convergence drift by manufacturing at least the suspension braces of the control electrodes of the gun system from a metal having a low coefficient of linear expansion. This solution is satisfactory for gun systems in which the first lens electrode (referred to as focusing electrode 3 in FIG. 1 of the U.S. Pat. No. 3,974,416), has such a small axial length that it can be secured to the assembly rods by means of only one suspension brace. However, if the axial length of the first lens electrode is such that this electrode, in order to obtain a sufficient mechanical stability, has to be secured by means of two suspension braces situated at an axial distance from each other, then it is found nevertheless that an impermissible degree of thermal convergence drift occurs.

SUMMARY OF THE INVENTION

It is the object of the invention to provide a color television display tube having an electron gun system in which measures are taken to compensate for the thermal convergence drift.

The invention, is useful in a color television display tube comprising an evacuated envelope and an electron gun system having three electron guns arranged in line to generate three converging electron beams. The electron guns each comprise, in the direction of propagation of the electron beams, a triode part, an elongate first lens electrode and a second lens electrode. The first lens electrodes are secured, nearby the triode part and nearby the second lens electrode, to insulating assembly rods extending substantially in the axial direction of the gun system by means of first and second metal suspension braces, respectively. The invention is characterized in that the first suspension braces of the outer electron guns are secured to the outer surface of the first lens electrodes remote from the central electron gun and the second suspension braces are secured to the outer surface of the first lens electrodes facing the central electron gun.

The thermal convergence drift in a color television display tube embodying the invention is reduced by approximately a factor 2 with respect to a tube in which the two suspension braces for the first lens electrodes of the outer electron guns are secured to the same side thereof, that is to the side facing the central electron gun.

BRIEF DESCRIPTION OF THE DRAWING

The invention will now be described in greater detail, by way of example, with reference to the drawing, in which.

DESCRIPTION OF THE PREFERRED EMBODIMENT

Figure 1:
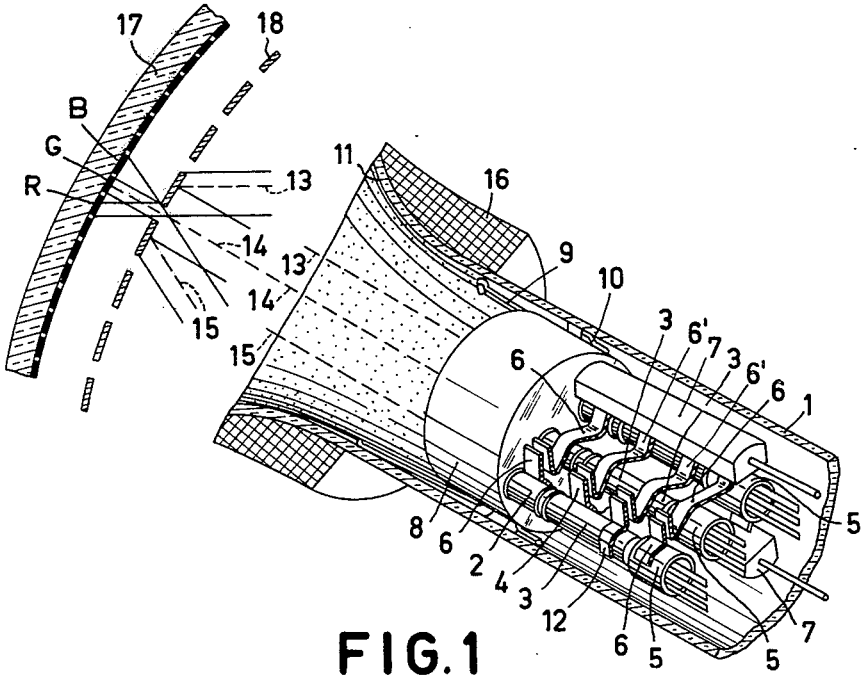
FIG. 1 shows an electron gun system in a color television display tube according to the invention.

FIG. 1 shows the neck portion and a part of the display screen of a color television display tube according to the invention. Accommodated in the neck 1 is an electron gun system having three electron guns arranged in line to generate three converging electron beams having axes denoted by 13, 14 and 15. Each gun comprises, centered along an axis, a triode part 5, a first lens electrode 3 (focusing electrode) and a second lens electrode 2 (acelerating electrode). The triode part 5 consists of a cathode, a control electrode and an anode, which, for reasons of simplification, are shown diagrammatically in the drawing as an integral construction and are not shown separately. The gun system is centered in the neck 2 by means of a centering sleeve 8 having two contact springs 9 and three centering springs 10. The contact springs 9 contact an electrically conductive layer 11 provided internally on the tube wall, while the centering springs 10 also serve as damping springs to avoid microphony. The electrodes of the electron gun system are secured to glass assembly rods 7 by means of metal suspension braces 4, 6, 6' and 12. The elongate first lens electrode 3 of the central gun is secured to the rods 7 by means of braces 6' situated at an axial distance from each other, while the first lens electrodes 3 of the two outermost guns are each secured to the rods 7 by means of braces 4 and 12 situated at an axial distance from each other. In all, four of such assembly rods are used, but in order to avoid complexity of the drawing, only two of them are shown.

It is shown in the drawing how the electron beams impinge on the display screen 17 in the case of correct convergence. The axes 13, 14 and 15 of the electron beams intercept each other in substantially one point on the display screen 17. Color selection is obtained by a shadow mask 18 mounted in the tube at a short distance from the display screen. The beams passed through the shadow mask impinge on a combination of phosphor regions luminescing in the colors red, green and blue, so that spots denoted by R, G and B are formed. These phosphor regions which are provided on the display screen as a pattern of lines, are hit successively by electron beams. A system 16 of coils arranged coaxially around the tube axis is shown diagrammatically in the drawing. These coils effect deflection of the electron beams in two mutually perpendicular directions.

During warm-up of the tube after switching on, the convergence of the electron beams changes so that the point of intersection of the axes 13, 14 and 15 is displaced along the axis 14. On the display screen 17 this results in a moving apart of the red and blue spots. In the case of over-convergence of the red and blue beams (13 and 15), the red spot R moves to the left in the drawing and the blue spot B moves to the right. In the case of under-convergence, the movement of the red and blue spots is in the opposite direction. As a result of this, annoying convergence errors occur in the picture displayed on the display screen 17. It has been found that thermal variation of convergence can be reduced by securing the suspension braces 4 and 12 of the outer electron guns to the first lens electrodes 3 in such manner that the braces 4 are situated inside, that is to say on the side facing the central gun, and the braces 12 are situated outside, that is to say on the side remote from the central gun. The braces 4 and 12 may each consist of two parts. The braces destined for the connection of the triode parts 5 may consist of a metal having a low coefficient of expansion, as is known from the U.S. Pat. No. 3,974,416.

Figure 2:
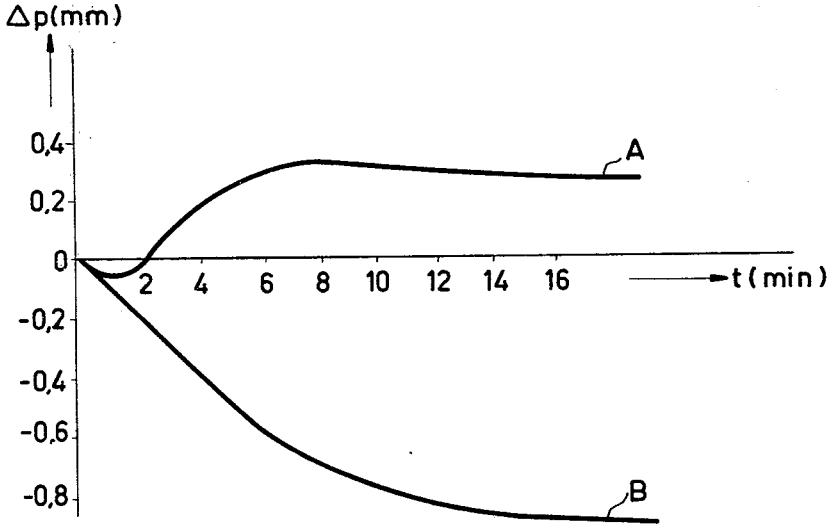
FIG. 2 illustrates the thermal convergence drift in a tube according to the invention as compared with that in a known display tube.

FIG. 2 shows, for two comparable cases, the mutual displacement $\Delta p$ in mm of the red and blue spots as a result of thermal convergence drift as a function of the time t in minutes. The curve B shows the displacement $\Delta p$ after switching on the tube at the instant $t=0$ min. for an electron gun system in which the braces 4 and 12 shown in FIG. 1 both extend on the inside, that is to say are both secured to the sides of the first electrodes 3 facing the central gun. In this case it appears that a mutual displacement $\Delta p$ of $-0.8$ mm occurs measured in the center of the display screen. The minus sign denotes that in this case convergence of the electron beams increases with time. Curve A denotes the variation of the displacement $\Delta p$ in the case in which the braces 4 and 12 are secured as shown in FIG. 1. An initial increase of the convergence changes into a decrease of the convergence and results in a mutual displacement $\Delta p$ of approximately $+0.4$ mm, which means an improvement by approximately a factor 2 with respect to the construction represented by curve B. It is difficult to give an explanation why the arrangement of the braces 4 and 12 shown in FIG. 1 gives a much more favorable result than the thermal convergence drift with the construction represented by curve B. It has been established, however, that a change of the construction such that the braces 4 extend around the outside and the braces 12 extend on the inside does not give the desired result with respect to the thermal convergence drift.

What is claimed is:

1. An electron gun system for a color television display tube, comprising three electron guns arranged in-line to generate three converging electron beams, each electron gun including a triode part, an elongate first lens electrode and a second lens electrode, said elongate first lens electrodes being secured to insulating rods by means of axially-spaced suspension braces, wherein the elongate first lens electrodes of the two outer electron guns are each secured by a first suspension brace nearer to the respective triode part and by a second suspension brace nearer to the second lens electrode, said first suspension brace being attached to the side of the electrode remote from the central electron gun and said second suspension brace being attached to the side of the electrode facing the central electron gun.

* * * * *